US006705193B2

(12) United States Patent
Koizumi

(10) Patent No.: US 6,705,193 B2
(45) Date of Patent: Mar. 16, 2004

(54) OPTICAL FIBERS FOR DECORATION

(76) Inventor: Takeshi Koizumi, 205 Grand E rue Hatsuishi, 2-159-1 Higashi Hatsuishi, Nagareyama-shi, Chiba-ken 270-0114 (JP)

( * ) Notice: Subject to any disclaimer, the term of this patent is extended or adjusted under 35 U.S.C. 154(b) by 0 days.

(21) Appl. No.: 10/207,030

(22) Filed: Jul. 30, 2002

(65) Prior Publication Data

US 2003/0110930 A1 Jun. 19, 2003

(30) Foreign Application Priority Data

Dec. 18, 2001 (JP) ..... 2001-402836

(51) Int. Cl.[7] ..... D04C 1/00
(52) U.S. Cl. ..... 87/9
(58) Field of Search ..... 87/8, 9, 11

(56) References Cited

U.S. PATENT DOCUMENTS 4,070,911 A * 1/1978 Makin ..... 374/208
4,891,511 A * 1/1990 Reed ..... 250/227.16
5,722,757 A * 3/1998 Chien ..... 362/555
5,838,860 A * 11/1998 Kingstone et al. ..... 385/100
6,368,318 B1 * 4/2002 Visuri et al. ..... 606/7

* cited by examiner

*Primary Examiner*—John J. Calvert
*Assistant Examiner*—Shaun R Hurley
(74) *Attorney, Agent, or Firm*—Kanesaka & Takeuchi

(57) ABSTRACT

An optical fiber band for decoration is formed of a plurality of optical fibers woven obliquely in a band shape. The band forms a mesh pattern, where each of the optical fibers changes positions above or below at least every two other fibers in a longitudinal direction of the fiber.

7 Claims, 4 Drawing Sheets

OPTICAL FIBERS FOR DECORATION

BACKGROUND OF THE INVENTION AND RELATED ART STATEMENT

The present invention relates to optical fibers for decoration that can fit on a curved surface and perform as a curved surface illumination.

Optical fibers for decoration, made of a synthetic resin in a rope form, have been contributed to practical use. The optical fibers are intermeshed or woven, and are covered by transparent tubes. A light source is provided at one end, and the diffuse light leaking out from a curved portion of the optical fiber at the intermeshing point, as the injected light reaches the other end, is utilized for the illumination.

However, according to this method, because the optical fibers form a thick rod-like light emitting body, it is necessary to use a large number of the optical fibers set in parallel to decorate a sheet-like part. Also the setting operations are extremely troublesome, and in particular it is impossible to decorate a whole curved surface of a shaped object, and the like.

In Japanese Utility Model No. 63-93523, it is disclosed to provide a sheet-like decorative device using the optical fibers. The optical fiber has a core part with a relatively high reflective index and a cladding part with a refractive index lower than that of the core part. The light injected from one end of the core part is led toward the other end of the core part with repeating the entire reflection at a boundary between the core part and the cladding part. Further, the optical fibers are woven together by mutually intermeshing to create points interrupting the entire reflections in specific parts in a longitudinal direction of the fibers, and the interrupting points form a surface of a light leaking decorative illumination. A semi-transparent diffusing screen layer is closely attached to a backside of the surface of the light leaking decorative part.

In this case, as shown in FIG. 5, because of intermeshing a plurality of optical fibers P and weaving closely together, the optical fiber P has a very short distance between the crossing points thereof.

For this reason, the meshes become tight, and in addition, the pressing force on the overlapping points is increased and the frictional resistance becomes extremely large. Thus, there is little flexibility in expansion and contraction.

Accordingly, while it is possible to lay the decorative device on a flat surface with a constant width, it is very difficult to cover a curved surface, for example, a complex contour such as an outer surface of a pot and a shaped object like an animal, a plant, a sculpture and a carved statue, a hemisphere or sphere, and a natural object such as a rock and a tree.

Accordingly, an object of the present invention is to provide optical fibers that can decorate a surface area, and the setting operation thereof is easy and convenient. The optical fibers can cover even a complex curved surface, for example, a complex contour such as an outer surface of a pot and a shaped object like an animal, a plant, a sculpture and a carved statue, a hemisphere or sphere, and a natural object such as a rock and a tree.

Further objects and advantages of the invention will be apparent from the following description of the invention.

SUMMARY OF THE INVENTION

The present invention provides optical fibers for decoration. The optical fibers are formed in a band shape constituted by braiding a plurality of optical fibers with a plurality of overlapping points. The overlapping points constitute meshes or cross-links so as to easily expand and contract in a pantograph form when applying a force in a width direction of the band form.

When expanding and contracting in the width direction of the band form, frictional resistance caused by sliding at the overlapping points becomes very small, and the pantograph form constituted by the overlapping points is capable of holding the meshes with a good balance.

DETAILED DESCRIPTION OF PREFERRED EMBODIMENTS

Hereunder, preferred embodiments of the present invention will be explained with reference to the accompanied drawings.

Figure 1:
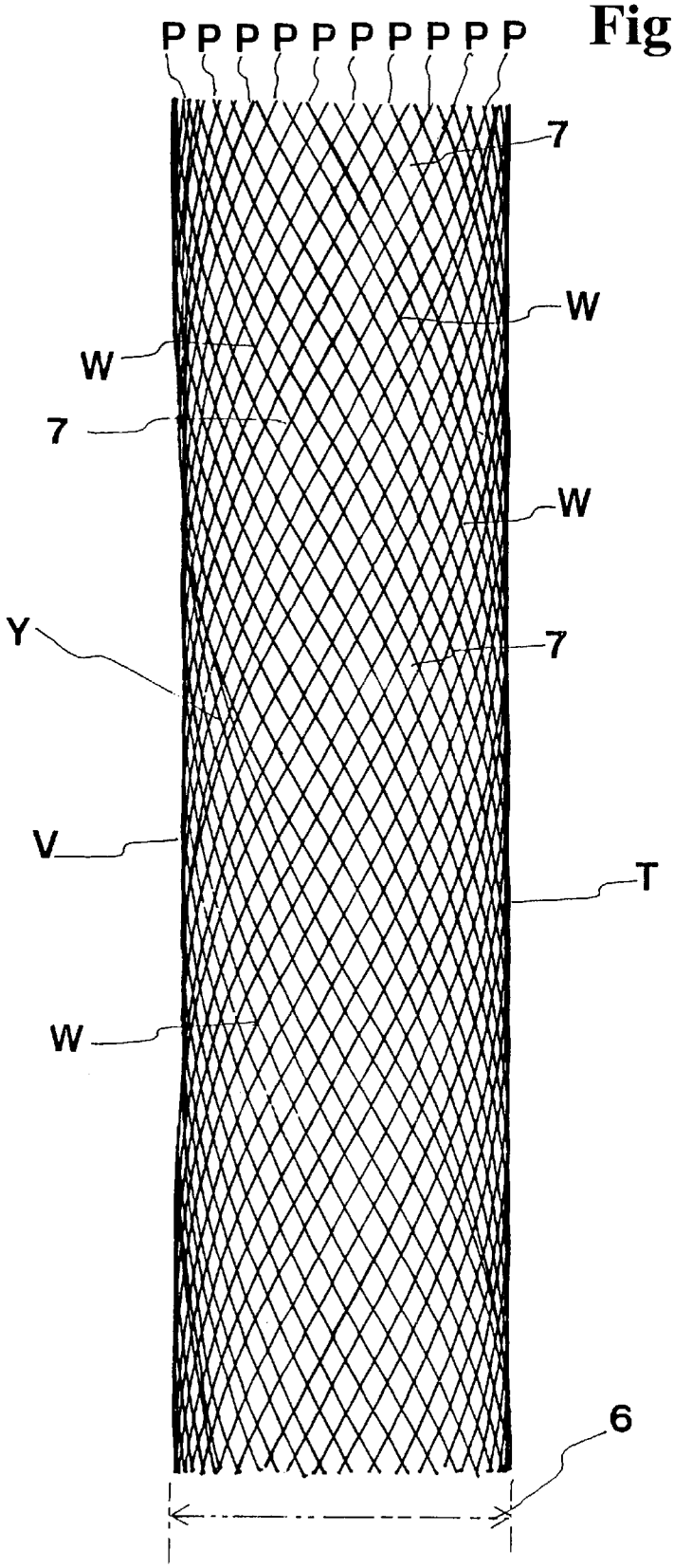
FIG. 1 is a plan view showing an embodiment of the present invention.
Figure 2:
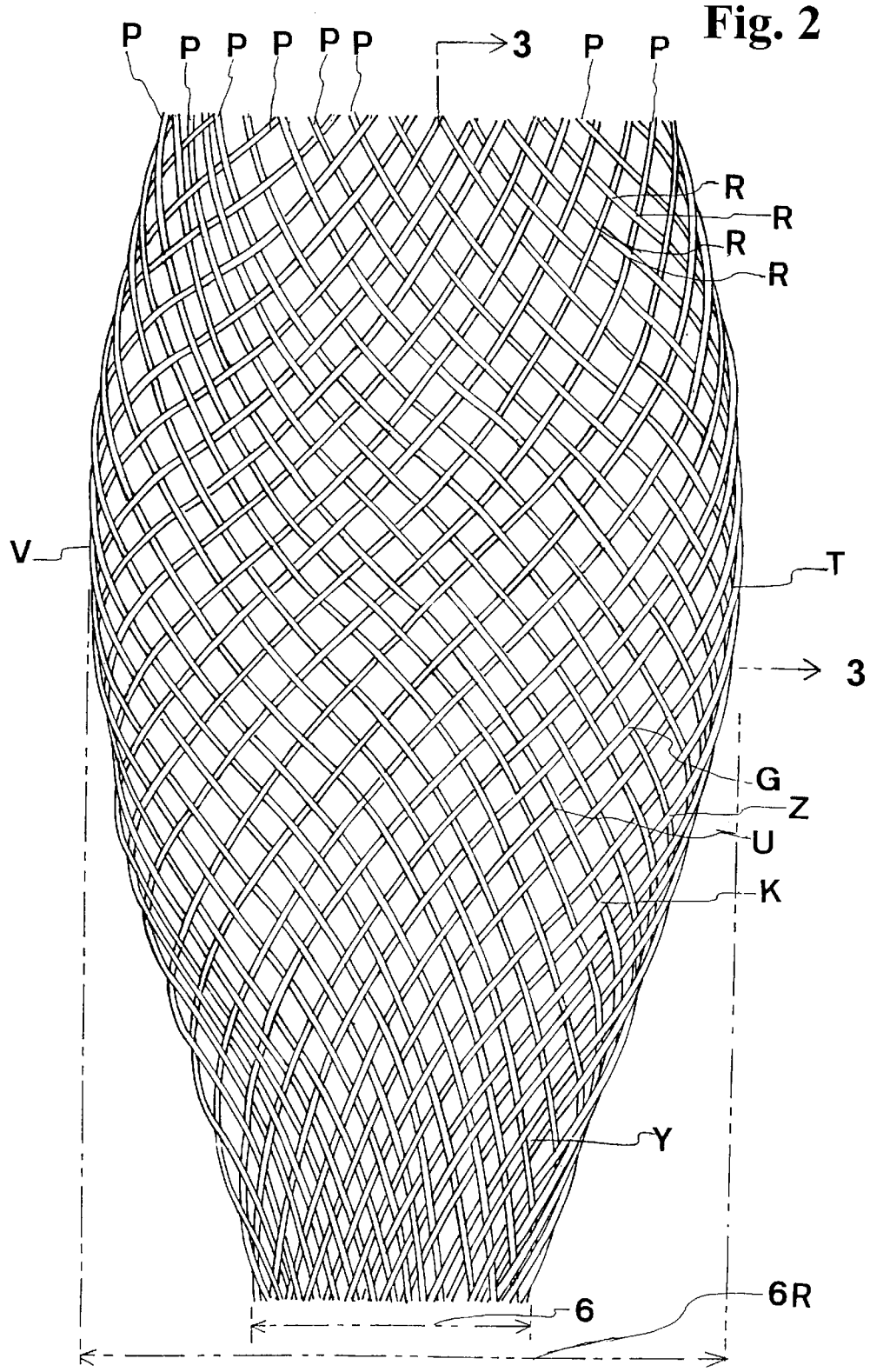
FIG. 2 is a plan view showing a state that optical fibers for decoration are extended in edge directions.
Figure 3:
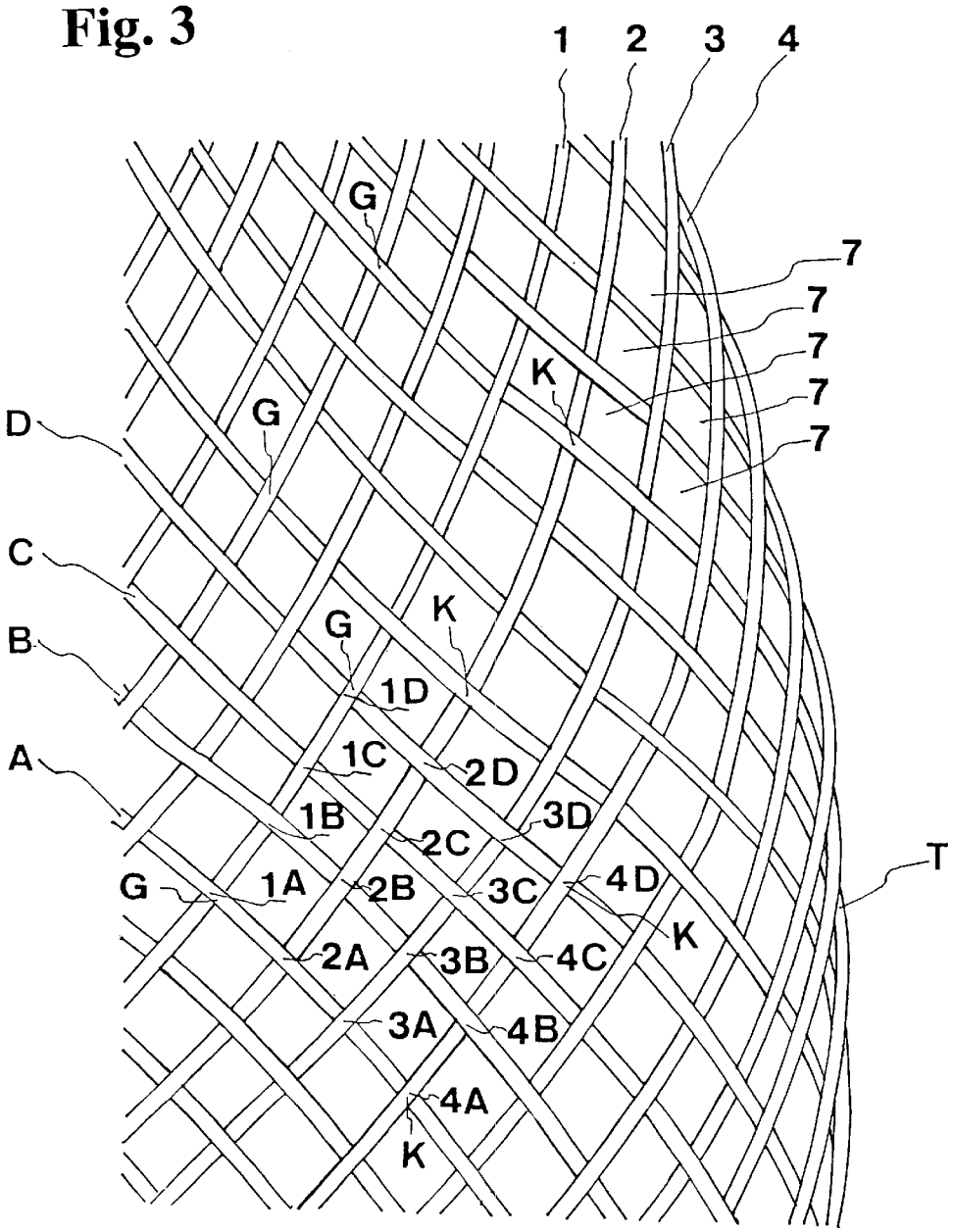
FIG. 3 is an enlarged plan view showing a part of FIG. 2.
Figure 5:
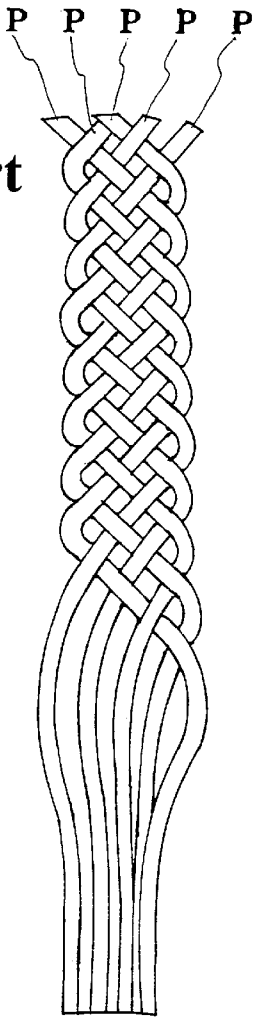
Fig. 5 Prior Art
FIG. 5 is a plan view showing the prior art.

FIG. 1 is a plan view showing a state that a plurality of the optical fibers P is braided in a band form. FIG. 2 is a plan view showing a state that a plurality of the optical fibers P constitutes the band form Y, and a force is applied partially to the side edge V and the side edge T, and the width 6 is widened. FIG. 3 is a plan view enlarging a part defined by lines 3 in FIG. 2, showing just one example of braiding the optical fibers P of the present invention.

A plurality of optical fibers P is woven in a band shape with a large number of meshes 7 via a large number of overlapping points R. The optical fibers have a sufficient thickness that the light leaks from sides of the optical fibers for illumination. The meshes expand and contract in a pantograph form.

It is desirable that the overlapping points R constitute the band form Y by loosely braiding the optical fibers P such that the optical fibers or meshes 7 easily perform movements like a pantograph.

In constituting the band form Y, one optical fiber intersects a plurality of other optical fibers, not a single fiber, so that a distance between the overlapping points R on the same optical fiber become larger than a woven form where a single fiber intersects every single fiber. When the band form Y is expanded and contracted in the width 6 direction, the frictional resistance at the overlapping points R, which is caused by being pressed at the overlapping points R, is alleviated, and expansion and contraction can be done extremely easily.

Accordingly, in constituting the band form Y, it is desirable that a large number of the overlapping points R be constituted so as to create a gentle curve from a side edge V to a side edge T.

Furthermore, it is desirable to maintain the meshes 7 in a pantograph diamond form, which are formed by the overlapping points R. The distance between an edge part G and an edge part K of the pantograph form should be as long as possible. When extending the side edge V and the side edge T outward, the overlapping points R are constituted such that the contact points of the overlapping points R slide against each other, so that the pantograph form of the meshes 7 can open and close to widen the width 6 freely, partly or entirely.

In FIG. 1, a plurality of the optical fibers P, which has a certain degree of elasticity and is made of a flexible synthetic resin, is constituted into the band shape Y via overlapping points R forming a plurality of the meshes 7 in a pantograph or diamond form in the same direction. A plurality of the meshes 7 in a pantograph form is formed such that the width 6 freely expands and contracts when a small force is applied to the side edge V or the side edge T, or both thereof, in the width direction 6. FIG. 2 is an enlarged view in a state that the width 6 in FIG. 1 is extended.

A relationship among the optical fibers P, the meshes 7 in the pantograph form, and the overlapping points R will be explained according to FIG. 3. In order to explain clearly the way of braiding the optical fibers P, the symbol P for the optical fibers in FIG. 1 and FIG. 2 is expressed as 1–4 and A–D in FIG. 3, and the symbol R for the overlapping points in FIG. 1 and FIG. 2 is expressed as 1A–4D in FIG. 3.

An example of the relationship between the optical fibers P and the overlapping points R is explained according to FIG. 3. An overlapping point 1A is formed such that an optical fiber A is positioned above an optical fiber 1; an overlapping point 1B is formed such that an optical fiber B is positioned above the optical fiber 1; an overlapping point 1C is formed such that an optical fiber C is positioned below the optical fiber 1; and an overlapping point 1D is formed such that an optical fiber D is positioned below the optical fiber 1.

An overlapping point 2A is formed such that an optical fiber A is positioned above an optical fiber 2; an overlapping point 2B is formed such that an optical fiber B is positioned below the optical fiber 2; an overlapping point 2C is formed such that an optical fiber C is positioned below the optical fiber 2; and an overlapping point 2D is formed such that an optical fiber D is positioned above the optical fiber 2.

An overlapping point 3A is formed such that an optical fiber A is positioned below an optical fiber 3; an overlapping point 3B is formed such that an optical fiber B is positioned below the optical fiber 3; an overlapping point 3C is formed such that an optical fiber C is positioned above the optical fiber 3; and an overlapping point 3D is formed such that an optical fiber D is positioned above the optical fiber 3.

An overlapping point 4A is formed such that an optical fiber A is positioned below an optical fiber 4; an overlapping point 4B is formed such that an optical fiber B is positioned above the optical fiber 4; an overlapping point 4C is formed such that an optical fiber C is positioned above the optical fiber 4; and an overlapping point 4D is formed such that an optical fiber D is positioned below the optical fiber 4.

Each of the optical fibers changes the location of the overlapping point for forming the mesh to above and below every several, i.e. two, overlapping points.

Accordingly, for example, when one small pantograph or diamond pattern constituted by the overlapping points 1A, 2A, 2B, and 1B, is in a state that the width 6 is narrow (a closed state), the pantograph form meshes 7 are in a narrowly closed state. When extended by applying a little force to the edge part U and the edge part T, it extends to form a number sign (#) shape.

One large pantograph shape defined by the overlapping points 1A, 4A, 4D, and 1D, is formed of nine of these small pantograph patterns.

Note that distances between the edge parts G and K of the large pantograph form are set to be long, so that the number of turns to change above and below at the respective overlapping points of the small pantograph forms becomes fewer. The pantograph form has a double structure, large and small, whereby each shape of the meshes 7 is stable and moves smoothly during expansion and contraction.

Due to the elasticity of the optical fibers P (FIG. 1, FIG. 2) restoring the original straight linear form, a force is generated at the overlapping points R and becomes a frictional force during expansion and contraction. However, as the distance between the edge parts G and K is set to be long (FIG. 3), the frictional resistance during expansion and contraction is greatly reduced to make the movement smoothly. Therefore, the optical fibers for decoration can cover an irregular surface area of a formed object, and the like, so that the decoration is effective and convenient, and creates a beautiful appearance. Also, the meshes 7 do not become irregular as the overlapping points constituting the small pantograph forms, for example 1A, 2A, 1B, and 2B, are held closely.

Also, as shown in FIG. 1 and FIG. 2, the optical fibers P form the band Y with the continuous patterns from the side edge T to the side edge V, drawing a gentle curve therebetween. When strong light is irradiated from the ends of the optical fibers P, the light leaks from the sides of the gently waved optical fibers P, which is a characteristic of the synthetic resin optical fiber, and the optical fibers P emit the light from the sides.

Accordingly, when a little force is applied to the side edge V or the side edge T or both in FIG. 1 to be pulled outward, the overlapping points 1D, 1A, 4A, and 4D respectively closely overlap each other as in FIG. 3 and are pressed by the elasticity of the optical fibers 1, 2, 3, and 4. The distance between the overlapping points 1A and 4D is extended by sliding of the contact points, while the distance between the overlapping points 1D and 4A is shortened by sliding of the contact points, in the same manner as axes of a pantograph. Accordingly, the distance between the side edges V and T in FIG. 1 becomes the expanded width 6R as shown in FIG. 2.

Figure 4:
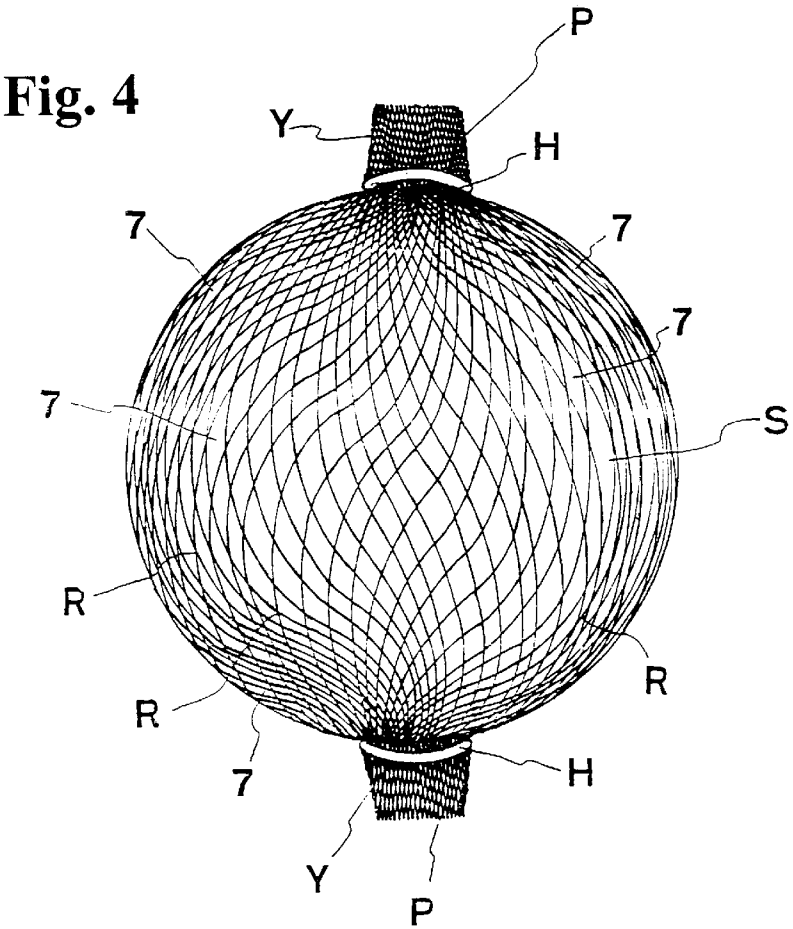
FIG. 4 is a plan view showing a state that a sphere is wrapped by optical fibers for decoration.

Therefore, the width 6 of the band shape Y is easy to expand and contract in response to a change in the surface area by a curved shape. For example, when the surface of a sphere S (FIG. 4) is covered, the band form Y is put on the sphere S and the width 6 is extended, and the side edge V and the side edge T may be bound together with string, or the like. In addition, binders H, H may be put on to wrap on the sphere S.

When the sphere S or a formed object, or the like, is large and can not be wrapped, a wider band form can be formed of a bundle of a plurality of the bands Y joined together at ends by using a transparent string, or the like. It is possible to decorate a larger structure and a tree, and the like. In such a case, the width 6 of the band form Y expands and contracts easily, and it can fit to fine surface changes.

Furthermore, when applying the decoration to a bumpy surface, it can be partially fixed to the decorated surface by an adhesive, a glue, staples, or a string, or the like, while expanding and contracting to cover the bumpy surfaces and the curved surface. Therefore, a setting operation is extremely easy, and in addition, because the optical fibers P overall are formed continuously with a gentle curve, the stable light is diffused with a good balance from the optical fibers. It is possible to apply decoration easily even to a complex curved surface such as surfaces of a sculpture and a carved statue, and a surface of a sphere.

As described above, it is possible to provide the optical fibers for decoration, and the setting operation is easy and convenient. The optical fibers can cover even a complex curved surface, for example, a complex contour such as an outer surface of a pot and a shaped object like an animal, a plant, a sculpture and a carved statue, a hemisphere or sphere, and a natural object such as a rock and a tree.

While the invention has been explained with reference to the specific embodiments of the invention, the explanation is illustrative and the invention is limited only by the appended claims.

What is claimed is:

1. An optical fiber band for decoration comprising:

a plurality of optical fibers woven obliquely in a band shape to form a mesh pattern where each of the optical fibers changes positions above and below at least every two other optical fibers in a longitudinal direction thereof.

2. An optical fiber band according to claim 1, wherein said optical fibers woven obliquely include overlapping points, overlapping points in one optical fiber changing the positions to above or below relative to other crossing optical fibers at least every two overlapping points.

3. An optical fiber band according to claim 2, wherein the overlapping points in one optical fiber relative to other optical fibers crossing to the one optical fiber are shifted by one in an optical fiber adjacent to the one optical fiber so that a same woven pattern in the optical fibers parallel to each other appears in at least every three other optical fibers.

4. An optical fiber band according to claim 3, wherein said optical fibers woven in the band includes open areas surrounded by the optical fibers, each having a diamond shape extending in a longitudinal direction of the band.

5. An optical fiber band according to claim 4, wherein sizes of the open areas change to decrease from a longitudinal center area to edge portions of the band.

6. An optical fiber band according to claim 5, wherein said optical fibers are made of slidable materials so that when a force is applied to the band, the sizes of the open areas change by sliding the optical fibers relative to each other.

7. An optical fiber band according to claim 6, wherein said optical fibers are made of a synthetic resin.

* * * * *